United States Patent [19]

Tinholt

[11] Patent Number: 4,842,020

[45] Date of Patent: Jun. 27, 1989

[54] DOUBLE-SOLENOID SINGLE-STEM FOUR-WAY VALVE

[75] Inventor: Thomas Tinholt, Galesburg, Mich.

[73] Assignee: Humphrey Products Company, Kalamazoo, Mich.

[21] Appl. No.: 234,467

[22] Filed: Aug. 19, 1988

Related U.S. Application Data

[63] Continuation-in-part of Ser. No. 226,265, Jul. 29, 1988.

[51] Int. Cl.[4] ..... F15B 13/044

[52] U.S. Cl. ..... 137/625.65; 137/625.26

[58] Field of Search ..... 137/625.26, 625.27, 137/625.49, 625.5, 625.65

[56] References Cited

U.S. PATENT DOCUMENTS

| | | | |
|---|---|---|---|
| 4,026,325 | 5/1977 | Loveless | 137/625.26 |
| 4,103,711 | 8/1978 | Arvin | 137/625.26 X |
| 4,301,715 | 11/1981 | Acar | 137/596.17 X |
| 4,494,572 | 1/1985 | Loveless | 137/625.5 X |
| 4,574,844 | 3/1986 | Neff et al. | 137/625.27 X |

*Primary Examiner*—Gerald A. Michalsky

*Attorney, Agent, or Firm*—Flynn, Thiel, Boutell & Tanis

[57] ABSTRACT

A four-way valve assembly provided with a housing having an elongate bore in which a single shiftable valve is slidably disposed. Electric solenoids are connected to opposite ends of the housing for effecting shifting of the valve between opposite ends positions. A pair of sleevelike liners are disposed in the bore, and an inlet port communicates with the bore between adjacent inner ends of the liners. A pair of load ports communicate with the bore through the individual liners and are spaced axially on opposite sides of the inlet port. A pair of exhaust ports communicate with the bore adjacent opposite ends thereof in axially outwardly spaced relationship relative to the load ports. The valve has an elastic valve ring mounted centrally of the rodlike stem and disposed to axially shift between and sealingly coact with valve seats formed on opposed inner ends of the liners. The stem also has radially enlarged cylindrical guide portions disposed in axially spaced relationship on opposite sides of the valve ring. The guide portions slidably engage the inner wall of the liners for maintaining the valve in centered alignment solely by positional engagement with the liners.

7 Claims, 3 Drawing Sheets

DOUBLE-SOLENOID SINGLE-STEM FOUR-WAY VALVE

CROSS REFERENCE TO RELATED APPLICATION

This is a continuation-in-part of my copending application Ser. No. 226 265, filed July 29, 1988, Atty Ref: Humphrey Case 42, and entitled "Double-Solenoid Single-Stem Four-Way Valve".

FIELD OF THE INVENTION

This invention relates to an improved double-solenoid single-stem four-way valve assembly.

BACKGROUND OF THE INVENTION

Numerous four-way valve assemblies have been developed for controlling both liquids and gases, and such assemblies incorporate a wide range of structural and functional features. Such four-way valve assemblies have, for many years, been of substantial size and have often incorporated multiple shiftable valves in order to provide for proper control over fluid flow. Modern technology, however, has increasingly demanded that such valve assemblies be made of extremely small size, particularly for use in control circuits. such assemblies must also permit shifting of the valve with extremely small force without detracting from the desired response time.

One of the common problems associated with many known four-way valves, particularly when they utilize shiftable valves of the poppet type, has been the fact that such assemblies often require at least two poppet-type shiftable valve stems in order to provide the desired structural and functional relationships. This increases the structural complexity of the valve assembly, including both the size and functional characteristics, and also significantly increases the manufacturing cost. The use of multiple valve stems also increases the number of wear points subject to failure and/or maintenance.

A further problem associated with known valve assemblies, particularly in those assemblies which are of extremely small size so as to be suitable for use in control systems, is the difficulty in maintaining proper tolerances including concentric relationships between the shiftable valve stem and the housing so as to permit optimum performance including minimization of shifting force. This precision of manufacture has often been compromised in view of difficulties in achieving such manufacture, or at least the impracticality of doing so at reasonable cost.

To improve upon many of the aforementioned disadvantages, the Assignee's copending application Ser. No. 158 084 illustrates an improved single-stem four-way valve employing a single solenoid actuator for the stem, coupled with a spring return. The valve assembly of this copending application is particularly desirable in view of the manner in which the valve stem is supported on lines which function to permit proper alignment of the housing end parts relative to the center housing part to achieve precise tolerance and dimensional control so as to permit minimization of parts and minimization of shifting forces. In this valve assembly, however, since the valve stem is slidably guided on the housing end parts, which in turn are aligned by the liners relative to the center housing part, the valve stem is preferably constructed of brass or similar material so as to be properly slidably disposed for direct engagement with the housing end parts (which are of steel). Constructing the stem of brass or similar soft material, however, creates a wear problem on the end of the stem due to contact by the solenoid plunger.

Accordingly, it is an object of the present invention to provide an improved four-way valve assembly employing a single stem actuated at opposite ends by opposed solenoids, which improved valve assembly incorporates an improved slidable support for the stem so as to permit constructions of the stem from steel or other suitable hard material while avoiding direct slidable support of the stem on the housing, while at the same time maintaining precise tolerance and dimensional control.

It is also an object of the invention to provide an improved valve assembly, as aforesaid, which slidably pilots the stem directly on liners which can be constructed of brass or similar material, with the liners in turn being stationarily supported on the housing.

It is a further object of the invention to provide an improved valve assembly, as aforesaid, which preferably employs a shiftable valve stem which is basically of the poppet type for controlling flow from an inlet port to a pair of load ports, with the poppet valve incorporating a detent function to assist in positively holding the valve in its selected position.

In the improved four-way valve assembly of the present invention, and specifically in the preferred embodiment thereof, there is provided a housing having an elongate bore in which is slidably disposed a single shiftable valve of the poppet type. A pair of sleevelike liners are stationarily disposed in the bore and cooperate with the housing for defining an inlet port which communicates with the bore in the region between the adjacent ends of the lines. A pair of load ports communicate with the bore through the individual liners and are spaced axially on opposite sides of the inlet port. A pair of exhaust ports communicate with the bore adjacent the opposite ends thereof. A single valve has a poppet mounted centrally thereof and disposed so as to axially shift between and sealingly coact with valve seats formed on the opposed inner ends of the liners. These latter valve seats are preferably formed as shallow recesses which create a slight elastomeric compression of the poppet valve. The single shiftable valve has the stem thereof preferably constructed of steel, and the opposite free ends of this stem are slidably supported on and project through seal rings mounted adjacent the opposite ends of the housing in the vicinity of the exhaust ports. The opposite ends of the stem are disposed directly adjacent and engaged by opposed ends of solenoid plungers for effecting shifting of the valve for flow selection purposes.

Other objects and purposes of the invention will be apparent to persons familiar with structures of this type upon reading the following specification and inspecting the accompanying drawings.

Figure 1:
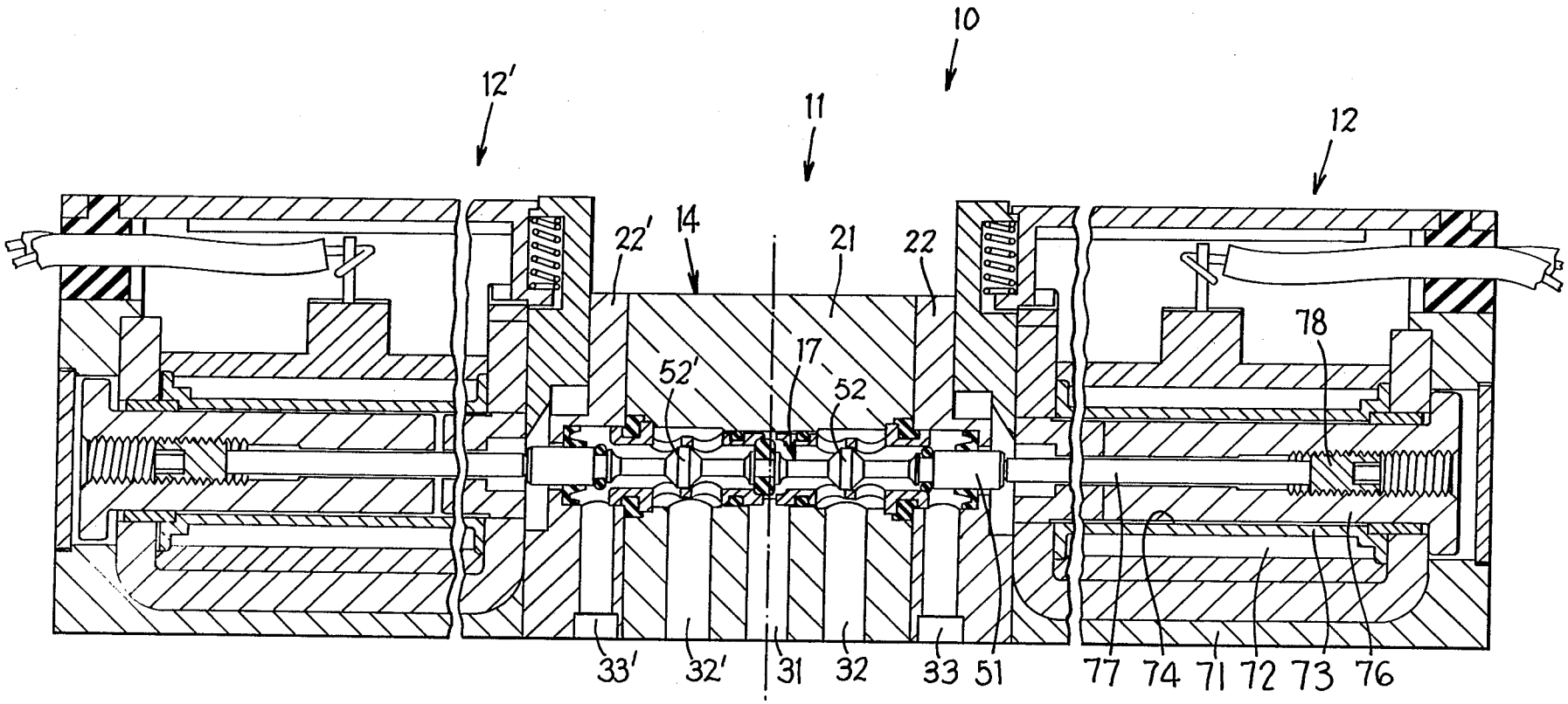
FIG. 1 is a longitudinal central sectional view of a valve unit according to this invention.

Certain terminology will be used in the following description for conference in reference only, and will not be limiting. For example, the words "upwardly", "downwardly", "leftwardly", and "rightwardly" will refer to directions in the drawings to which reference is made. The words "inwardly" and "outwardly" will refer to directions toward and away from, respectively, the geometrical center of the valve assembly and designated parts thereof. Said terminology will include the words specifically mentioned, derivatives thereof, and words of similar import.

DETAILED DESCRIPTION

FIG. 1 illustrates a valve unit 10 which is formed by a four-way valve assembly 11 connected to operator assemblies 12 and 12'. The valve assembly 11 includes a housing 14 having a substantially cylindrical bore 16 formed therein, and a single shiftable valve 17 is axially slidably and sealingly disposed within the bore.

The valve assembly 11, including its shiftable valve 17 when the latter is disposed midway between its end positions, is substantially symmetrical (i.e., a mirror image) about a central transfer plane 19. Hence, parts of the unit 10 which are on the left side of this plane 19 are designated by the same reference numeral used to designate corresponding parts on the right side but with the additional of a prime (') thereto.

The housing 14 includes a main or central housing part 21 having opposite end housing parts 22 and 22' fixedly secured to opposite ends thereof, as by bolts. The bore 16 is formed within all of these housing parts and includes a cylindrical bore portion 23 which extends longitudinally through the center housing part 21 and coaxially communicates with similar bore portions 24 and 24' formed in the respective end housing parts. These bore portions 24 and 24' are normally of substantially the same diameter as the center bore portion 23, but terminate in respective annular shoulders 26 and 26'. Smaller diameter bores 27 and 27' project coaxially outwardly from the shoulder through the other surface of the respective housing end part.

The housing 14 includes at least four, and preferably five, ports formed therethrough for communication with the bore 16. This includes an inlet port 31 which projects radially inwardly of the center housing part 21 for communication with the bore 23 adjacent the midpoint thereof. This center housing part 21 also has first and second load ports 32 and 32' formed radially thereof for communication with the bore 16. These load ports 32 and 32' are axially spaced so that the inlet port 31 is disposed substantially axially midway therebetween. The end housing part 22 has a first exhaust or discharge port 33 formed therethrough for communication with the end of the bore 16, that is, for communication with the end bore portion 24. The other end housing part 22' has a second exhaust or discharge port 33' formed therethrough for communication with the respective bore portion 24'. With this arrangement, the first load port 32 communicates with the bore 16 axially between the inlet port 21 and the discharge port 33, and the second load port 32' communicates with the bore at a location disposed axially between the inlet port 31 and the other discharge port 33'.

To slidably but sealingly support the single shiftable valve 17 relative to the housing 14, a pair of identical sleevelike liners 36 and 36' are stationarily and sealingly supported on the housing within the bore 16. These liners slidably support the shiftable valve 17 therein, and are symmetrically positioned in axially opposed relationship relative to the plane 19, the latter passing through the central axis of the inlet port 31.

Considering the construction of the liner 36, its outer end includes an annular flange portion 37 which is seated against an annular shoulder formed on the center housing part in slightly inwardly spaced relationship from the end face thereof to thereby axially position the liner relative to the center housing part. This flange portion 37 has a surrounding annular groove in which a resilient or elastomeric O-ring 38 is captivated, the latter being sealingly engaged with the housing. A further enlarged annular flange 39 is provided on the inner end of the liner, which flange 39 is disposed axially close adjacent one side of the inlet port 31. Flange 39 also has a surrounding annular groove in which is captivated a further elastomeric O-ring 41 which is maintained in sealing engagement with the center housing part. This flange 39, on the inner axial end thereof, defines an annular valve seat 42 which surrounds a bore 43 which extends axially through the liner. The configuration of this valve seat 42 is explained below.

The liner 36, between the flange 37 and 39, is of smaller outer diameter so as to define a surrounding annular groove 44 which communicates with the load port 32. The liner 36 also has a least one, and preferably plural, openings of ports extending through the wall thereof to provide communication between the bore 43 and the surrounding groove 44. In the preferred and illustrated embodiment, the liner has a pair of such ports 46 and 47 which are disposed adjacent but slightly axially spaced apart by a small immediate liner wall portion 48. A plurality, preferably at least two disposed in diametrically opposite relationship, of such ports 46 and 47 are provided.

Figure 2:
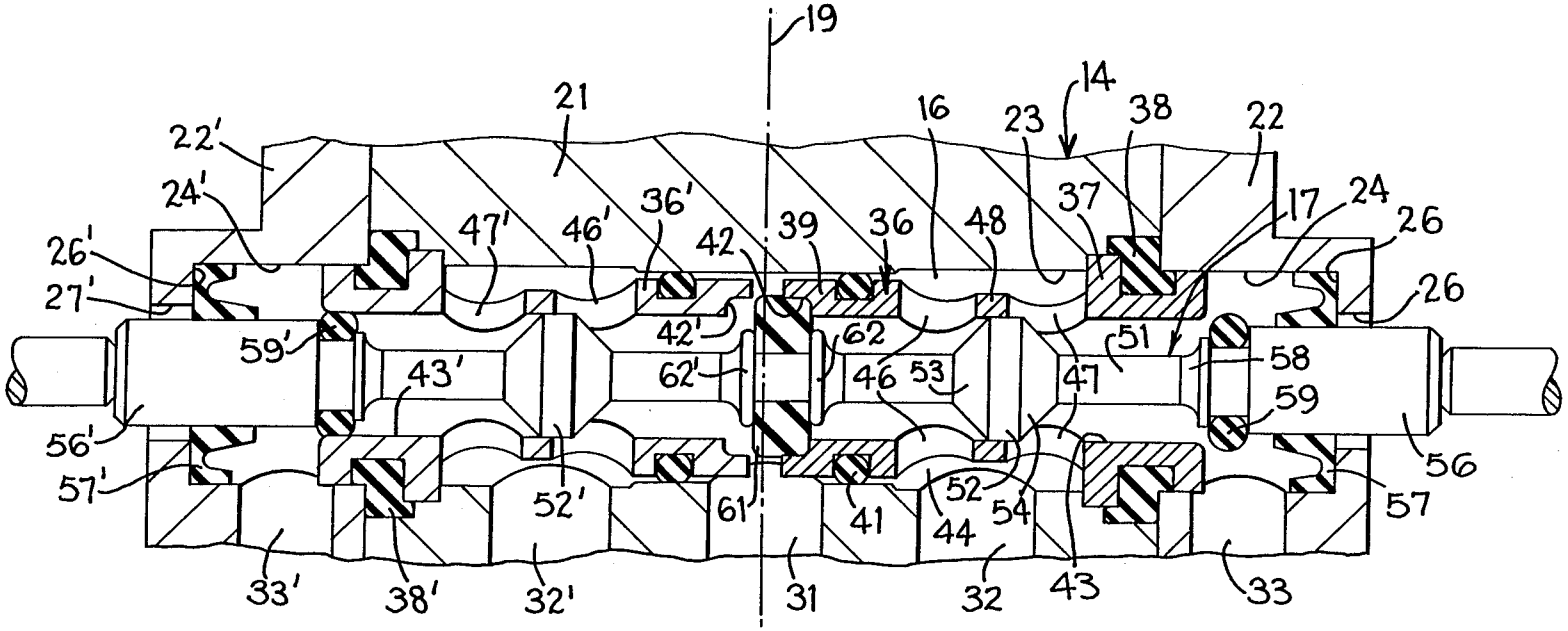
FIG. 2 is an enlarged, fragmentary sectional view of the central portion of the assembly shown in FIG. 1.

When the liners 36 and 36' are positioned within the bore of the center housing part, the lines are axially spaced a small distance apart so that the valve seats 42 and 42' face one another and are disposed a small axial distance apart. The inlet port 31 communicates directly with the region of the bore defined axially between the opposed valve seats, substantially as illustrated by FIGS. 1 and 2.

Considering now the shiftable valve 17, it includes a one-piece valve stem formed substantially by an elongated rod 51 which is of rather small diameter and projects coaxially of the aligned liner bores 43 and 43'. This rod 51, axially spaced from and on opposite sides of the center plane 19, defines thereon cylindrical guide portions 52 and 52' which are of larger diameter so as to snugly fit within but be freely axially slidably supported on the internal wall defining the bores 43 and 43'. The cylindrical guide portion 52 is slidably supported on the respective bore wall 43 at the intermediate portion 48 located between the ports 46 and 47, and hence this guide portion 52 has an axial length which approximately corresponds with the axial length of the wall portion 48. Guide portion 52 joins to the smaller diameter of the rod 51 through generally truncated conical portions 53 and 54 which project axially in opposite directions from the guide portion 52 so as to merge into the smaller diameter of the rod 51. These guide portions 52 and 52' provide the sole means for maintaining the rod 51 in proper centered but slidably supported relationship relative to the liners 36 and 36'.

The rod 51, adjacent the opposite axial free ends thereof, also defines thereon enlarged cylindrical parts 56 and 56' which slidably project through and are sealingly engaged by annular seals 57 and 57' which are confined by the respective end housing parts. These cylindrical portions 56 and 56', however, are sufficiently smaller than the surrounding bores 27 and 27' so as to provide a substantial clearance space therebetween to prevent any guiding of the rod 51 by the housing parts. This facilitates the manufacture and assembly of the housing in terms of eliminating the criticality of tolerances between the end housing parts and the center housing part.

The valve rod 51 has a radially surrounding flange 58 spaced axially from the adjacent inner end of the enlarged cylindrical portion 56 to define an annular groove therebetween in which an elastomeric O-ring 59 is captivated, the latter being adapted to be slidably engaged with the inner wall of the bore 43 to control flow into the discharge port 33. A similar flange and O-ring adjacent the other end of the valve rod 51 controls flow into the other discharge port 33'. These O-rings 59 and 59' are axially spaced apart by distance which slightly exceeds the distance between the end surfaces of the flanges 37 and 37' to control flow into the discharge ports 33 and 33'. When the valve 17 is in the end position illustrated by FIG. 2, the O-ring 59' sealingly engages the liner 36' so as to close off the discharge port 33', whereas the other O-ring 59 is spaced axially outwardly to permit the discharge port 33 to communicate with the bore of the liner. When the valve 17 is shifted into its other end position, then the positional and operative relationships of the O-rings 59 and 59' are reversed.

The valve 17, substantially at the midpoint thereof, also stationarily amounts thereon a surrounding elastomeric poppet-like seal ring 61, the latter being captivated between rod flanges 62 and 62'. This seal ring 61 is of greater diameter than the adjacent portions of the valve stem, and has an axial width less than the axial spacing between the opposed valve seats 42 and 42'. The seal ring 61 is shifted into sealing engagement with the valve seat 42 by means of the operator 2', this position being illustrated in FIG. 2. However, when the opposite operator 12 is energized, then this effects shifting of the valve 17 leftwardly so that the seal ring 61 is sealingly engaged with the opposite valve seat 42'.

Figure 3:
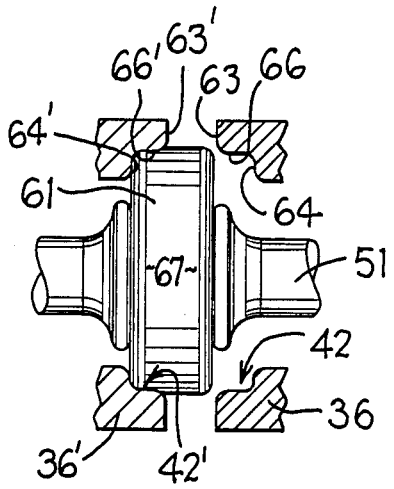
FIG. 3 is an enlarged, fragmentary view illustrating the cooperation between the poppet and opposed valve seats.
Figure 4:
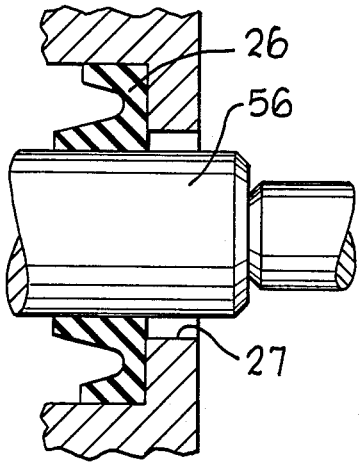
FIG. 4 is an enlarged, sectional view showing the end of the stem and the adjacent solenoid plunger end.

The cooperation of the seal ring 61 with the valve seats 42 and 42', due to the configuration of these latter seats, creates both a sealed engagement and a detent-like holding engagement. Referring specifically to FIG. 3, the valve seat 42 is defined by a shallow groove as formed in the inner end of the respective sleeve 36, which groove opens axially away from the inner axial end face 63 so as to define an annular surface 64 which is part of the seal face 42. This annular seal face 64 projects radially outwardly from the inner bore of the sleeve 36. The groove defining this valve seat 42 in turn defines another annular wall 66 which projects axially away from the end surface 63 through a limited extent, with these annular surfaces 64 and 66 extending generally in perpendicular relationship to one another and being joined together by a rounded corner. The axial depth of the groove defining the valve seat 42, which depth substantially equals the axial spacing between the surfaces 63 and 64, is preferably less than one-half the axial width of the seal ring 61. In addition, the seal ring 61 has an outer generally cylindrical surface 67 which, when the elastomeric seal ring is in a nondeformed condition, has an outer diameter which slightly exceeds the diameter of the annular surface 66. This difference in diameter is preferably very small, such as in the range of about 0.002 to about 0.005 inch. When the seal ring 61 sealingly engages one of the valve seats, such as its engagement with the seat 42' as illustrated in FIG. 3, this results in a slight radially inwardly directed compression of the seal ring over a portion of the axial width thereof, thereby causing a sealing engagement with the surounding seal surface 66' (which sealing engagement may be against both surfaces 64' and 66'). The unbalanced pressure acting against the right side of seal ring 61 effectively holds the valve 17 in the selected position so that both electric operators 12 and 12' can remain in a de-energized condition.

To operate in the above desirable manner, the seal ring 61 is preferably constructed of an elastomeric material having a durometer of about 70.

The rod 51 and the enlargements 52 and 52' integrally associated therewith is preferably constructed of steel, specifically non-magnetic stainless steel. The bushings 36 and 36', on the other hand, are preferably constructed of bronze or of a material having similar properties so as to enable direct slidable engagement with the guide portions 52 and 52' to maintain a proper dimensionally centered relationship without restricting the desired sliding movement of the valve.

The operator 12 is a generally conventional electrically actuated solenoid arrangement having a housing 71 which mounts therein a conventional solenoid winding 72, the latter surrounding an inner housing sleeve 73 which defines a bore 74 which is substantially aligned with the bore in the valve assembly. A solenoid plunger armature 76 is slidably supported within the bore 74, and additionally includes.a plunger rod 77 slidably supported coaxially thereon so that one end of this rod 77 is adapted to project outwardly for alignment with and abutting contact with the free end of the valve rod 51. The plunger rod 77 has the other end thereof adapted to abuttingly contact a stop 78 which is threadably adjustably secured to the plunger armature 76. When the solenoid is energized, plunger sleeve 76 and rod 77 are moved axially inwardly (leftwardly in FIG. 1) so as to shift the valve 17 from a rightward-most end position into the leftward-most end position illustrated by FIG. 1. On the other hand, when the other solenoid 12' is energized, then the valve 17 is shifted from the position of FIG. 1 into the position illustrated by FIG. 2.

OPERATION

The operation of the valve unit 10 will be briefly described to ensure a complete understanding thereof.

With the valve unit 10 in the position illustrated by FIG. 1, both solenoids 12 and 12' can be deenergized, and the shiftable valve 17 will remain in its leftward most position wherein the seal ring 61 is sealingly engaged with the valve seat 42'. The unbalanced pressure acting on one side of the seal ring 61 holds the valve 17 in this end position. Due to the interference between the outer seal surface 66 and the periphery of the seal ring 61, this also assists in holding the shiftable valve 17 in this end position. Pressure fluid supplied through inlet port 31 flows through the bore of sleeve 36 and thence outwardly through ports 46 into the first load port 32. The truncated conical surface 53 adjacent the ports 46 and assists in deflecting the pressure fluid outwardly through the ports 46. In this position, the seal ring 59 is sealingly engaged within the end of the bore of sleeve 36 so that the discharged port 33 is sealingly isolated from the load port 32. At the same time, however, the other load port 32' communicates via ports 47' with the bore of sleeve 36', and thence with the discharge port 33' so as to permit pressure relief of any device connected to the load port 32'. In this position, a substantial pressure unbalance is imposed on the valve stem since the pressure fluid within the bore of sleeve 36 acts against the seal ring 59 at one end, and against the maximum diameter of the seal ring 61 at the other end. Since the ring 61 has a diameter which is slightly greater than the diameter of the liner bore, a slight axially-directed pressure unbalance exists which holds the ring 61 in sealing engagement with the valve seat 42'.

When reversing of the flow is desired, then solenoid 12' is momentarily energized so as to cause extension of the plunger (rightwardly in FIGS. 1 and 2) so as to cause rightward shifting of the valve 17 into the position illustrated by FIG. 2. This results in a flow reversal in that the inlet port 31 now connects to the load port 32', and load port 32 now connects to the discharge port 33. The engagement of the seal ring 61 with the valve seat 42 is the same as its cooperation with the valve seat 42', as explained above.

During the above axial shifting of the valve 17 between its opposite end positions, the axially-spaced cylindrical guide portions 52 and 52' effectively slidably pilot the valve 17 within the sleeve 36 and 36' so as to maintain proper alignment of the valve 17 within the sleeve bores to enhance valve operation both with respect to the axial sliding of the valve stem and its proper sealing engagement between the various elastomeric elements and the associated sealing surfaces on the liners.

Due to the manner in which the stem is slidably guided directly on and solely by the sleeve 36 and 36', which sleeves are preferably constructed of brass or similar material, the rod 51 can be constructed of steel (preferably non-magnetic stainless steel), and the free ends of the rod 51 can be disposed for direct contact with the solenoid plungers without requiring any intermediate wear member. This also greatly minimizes the tolerance and alignment necessary when the housing end parts are assembled to the housing center part. While the illustrated embodiment of the invention discloses the housing end parts piloted relative to the housing center part due to the housing end parts being supported on substantially cylindrical extensions of the sleeves 36 and 36', substantially as illustrated and described in the aforementioned copending application Ser. No. 158 084, such is preferred but not required in the valve unit of the present invention.

Although a particular preferred embodiment of the invention has been disclosed in detail for illustrative purposes, it will be recognized that variations or modification of the disclosed apparatus, including the rearrangement pf parts, lie within the scope of the present invention.

The embodiments of the invention in which an exclusive property or privilege is claimed are defined as follows:

1. A single-stem four-way valve assembly, comprising:

housing means having substantially cylindrical bore means formed therein and extending therethrough;

a supply port formed in said housing means and communicating with said bore means substantially adjacent a midpoint thereof;

first and second load ports formed in said housing means and communicating with said bore means on axially opposite sides of said supply port;

first and second discharge ports formed in said housing means and communicating with said bore means at locations spaced axially outwardly from said first and second load ports, respectively;

first and second axially elongated sleevelike liners positioned within said bore means and projecting axially outwardly of said bore means in opposite directions from opposite sides of said supply port, said first and second liners being substantially identical and disposed so as to be substantially mirror images of one another relative to a central transverse plane extending through said supply port, said liners having annular valve seats formed on axially inner ends thereof so that said valve seats are disposed adjacent one another but on axially opposite sides of said supply port;

a single elongated and axially shiftable valve slidably supported within said liners for controlling flow of fluid between said ports, said valve including an elongated rodlike stem disposed within and extending substantially coaxially along said liners, said valve also having radially enlarged annular elastomeric ring means mounted on said stem substantially axially midway thereof and disposed axially between the valve seats for creating sealing engagement with one or the other valve seat as the valve is shifted axially between one or the other end position;

said rodlike stem having first and second radially-enlarged cylindrical guide portions fixedly associated therewith and disposed in axially-spaced relationship on opposite sides of said elastomeric ring means, said guide portions being snugly but freely axially slidably supported on cylindrical inner walls defining the bores through said lines, said first and second cylindrical guide portions being respectively disposed close to the point where said first and second load ports communicate with said bore means;

each said liner having opening means extending radially therethrough for providing communication between said bore and the respective load port; and first and second electrically-operated solenoid means for respectively effecting shifting of said valve into said one and said other end position, each said solenoid means having a reciprocal plunger coaxially aligned with and disposed adjacent a respective end of said rodlike stem for engaging and shifting said stem in response to actuation of the respective solenoid means.

2. A valve assembly according to claim 1, wherein said liners are constructed of brass or other suitable nonferrous bearing material, and wherein said cylindrical guide portions are constructed of steel.

3. A valve assembly according to claim 1, wherein each of said valve seats is formed by a shallow annular groove formed in the respective liner, said shallow groove projecting axially away from the axially inner free end of the respective liner, said shallow groove also projecting radially outwardly from said bore through a small radial extent, whereby said valve seat is defined by a first annular surface which projects radially outwardly from said bore and which is smoothly joined at its radially outer end to a second annular surface which projects axially through the free axially-inner end surface of said liner, said elastomeric ring means comprising a single elastomeric ring of generally cylindrical configuration having an outer cylindrical wall of a first diameter when in a nondeformed condition, said second annular surface being of a second diameter which is slightly smaller than said first diameter so that engagement of said elastomeric ring with the respective valve seat causes slight radially-inward elastomeric compression of said elastomeric ring to achieve both a sealing engagement and a holding engagement between the outer cylindrical surface of said elastomeric ring and second second annular surface.

4. A valve assembly according to claim 3, wherein said cylindrical guide portions are integral with said stem, said stem is constructed of stainless steel, and said liners are constructed of brass or other suitable nonferrous bearing material.

5. A valve assembly according to claim 3, wherein said second diameter is about 0.002 to about 0.005 inch smaller than said first diameter.

6. A valve assembly according to claim 3, wherein said cylindrical guide portions have truncated conical surfaces formed on axially opposite sides thereof for merging with the smaller diameter of the stem to facilitate fluid flow deflection from an axial direction to a radial direction, or vice versa.

7. A valve assembly according to claim 1, wherein each said opening means has first and second opening portions which provide communication with said bore on axially opposite sides of the respective cylindrical guide portion.

* * * * *